US005675952A

United States Patent [19]

French

[11] Patent Number: 5,675,952

[45] Date of Patent: Oct. 14, 1997

[54] FINISHING PLUG FOR PRODUCING SQUARE INSIDE CORNERS ON A WORKPIECE

[76] Inventor: Nicholas A. French, P.O. Box 40, Douglas, Mich. 49406

[21] Appl. No.: 668,545

[22] Filed: Jun. 21, 1996

[51] Int. Cl.[6] ..... E06B 3/70

[52] U.S. Cl. ..... 52/455; 52/316; 52/656.4; 144/353; 144/371

[58] Field of Search ..... 52/455, 456, 457, 52/314, 316, 656 H; 144/353, 371, 134.1, 136.1

[56] References Cited

U.S. PATENT DOCUMENTS

| | | | |
|---|---|---|---|
| 3,543,464 | 12/1970 | Taylor | 52/656.4 X |
| 4,707,204 | 11/1987 | Heeg | 52/456 X |
| 4,783,945 | 11/1988 | Heeg | 52/656.4 |
| 4,870,797 | 10/1989 | Hegemeyer | 52/455 |
| 5,458,433 | 10/1995 | Stastny | 144/353 X |

*Primary Examiner*—Carl D. Friedman
*Assistant Examiner*—Creighton Smith

[57] ABSTRACT

This relates to a workpiece particularly a simulated raised panel door as used on furniture and kitchen cabinets. Such doors are fabricated from a single sheet of core material and have a panel section machined into its face. In certain specific instances it is desired that the corners of the machined panel section be square and at best of very low radii. Because of this corner design it is virtually impossible and definitely time consuming to machine such corners in volume. The problem is solved by using preformed corner plugs inconjunction with a machined core. The core is composed of standard fiberboard material with a panel section machined into its face and plug housings machined into the face of the core at the panel section's proposed square corners. The corner plug is composed of a plastic material formed in part to that of a typical woodworking plug of cylindrical shape and a square inside corner section formed into the face and edge of the plug. Therefore, the square inside corner is formed by assembling the prefabricated corner plug into the plug housing of the core filling in the plug housing and completing the corner detail of the machined panel section.

4 Claims, 3 Drawing Sheets

FINISHING PLUG FOR PRODUCING SQUARE INSIDE CORNERS ON A WORKPIECE

BACKGROUND OF INVENTION

This invention relates to a finishing plug for fabricating a square inside corner on the face of a workpiece; and, more particularly, for making square inside corners for simulated raised panel doors as used on furniture and kitchen cabinets.

It is well known the construction of conventional raised panel doors as shown in FIG. 1. The conventional door consists of a center panel 1 and four frame parts 2,3,4 and 5. Prior to assembling parts 1–5, various radii 6*a*, 6*b* and chamfers 6*c* are cut into the parts. As shown in FIG. 2, the center panel fits into a U-shaped groove.

It is also well known the construction of simulated raised panel doors as shown in FIG. 3. The simulated door is formed by machining the various radii and chamfers of the conventional door into the face of a single sheet of material, such as medium density fiberboard. The radii and chamfers are reproduced using various router bits also shown in FIG. 3. The resulting fabricated door has a similar appearance to the conventional raised panel door. The simulated door is generally less expensive to produce than the conventional door plus has no joints that can separate. The major disadvantage of the simulated method is the inability to reproduce the square inside corners that result from the assembly of parts 1–5 of the conventional method.

The inability to reproduce the square inside corners in the simulated method is the result of the use of router bits and particularly router bit 7 as shown in FIG. 3. Router bit 7 being of a cylindrical shape including a circumferential curved cutting blade 8 prohibits it from cutting a square inside corner. As shown in FIG. 4 the surface shape of router bit 7 leaves corner 9, a curved corner, the radius of which equals the radius of the router bit. One can overcome the affects of curved corners by using a router bit which comes to a point or a chisel. However, these techniques for producing square inside corners are expense and time consuming.

Accordingly, it is the objective of the present invention to provide:

a. an improved method for fabricating a workpiece that comprises an inside square corner;

b. an improved method for fabricating an interior square corner having the same appearance as a conventional raised panel door.

REFERENCE NUMERALS IN DRAWINGS

| | |
|---|---|
| 1 | center panel |
| 2,3,4,& 5 | frame parts |
| 6a, 6b | radii |
| 6c | chamfers |
| 7 | router bit |
| 8 | circumferential curved cutting blade |
| 10 | finishing plug |
| 12 | flat region of finishing plug 10 |
| 16 | plug housing |
| 18 | simulated raised panel door |
| 20 | square inside corner |

DESCRIPTION OF THE PREFERRED EMBODIMENTS

Figure 1:
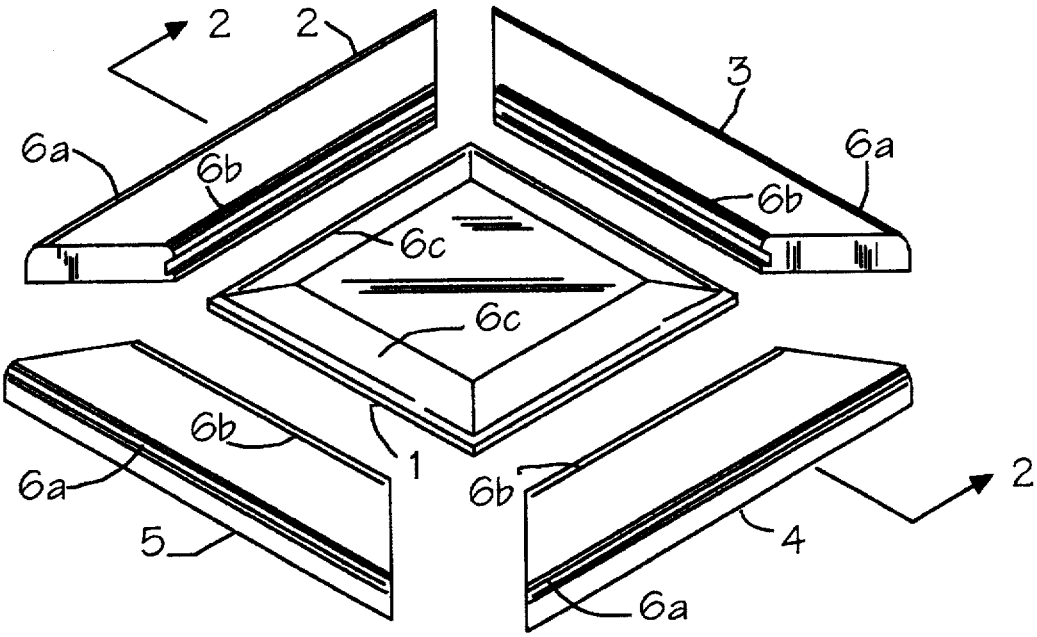
FIG. 1 is an exploded perspective view of the conventional raised panel door.
Figure 2:
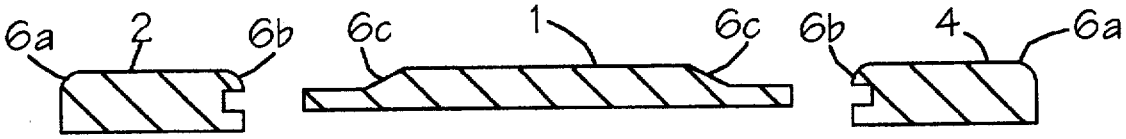
FIG. 2 is a sectional view of the conventional door of FIG. 1, taken along the lines 2—2 of FIG. 1.
Figure 3:
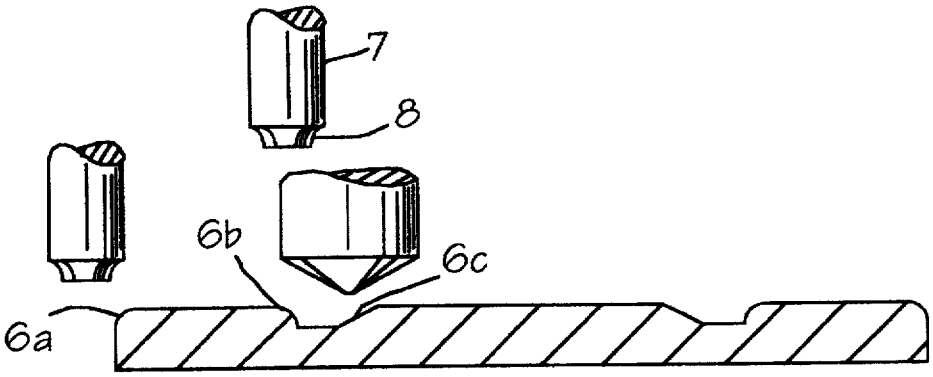
FIG. 3 is a sectional view of a simulated door.
Figure 4:
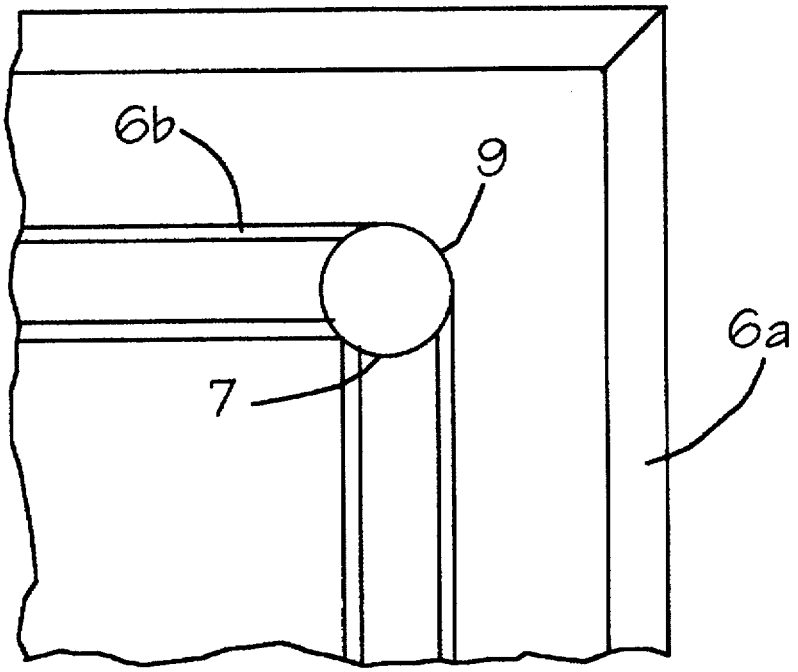
FIG. 4 is a detail view of the simulated door of FIG. 3.
Figure 5:
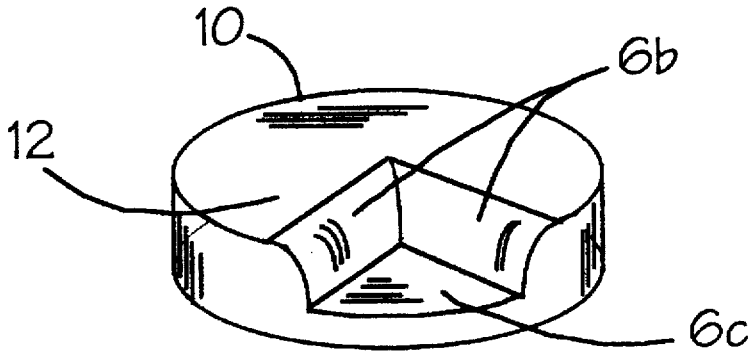
FIG. 5 is a perspective view of the preferred embodiments of the article of the present invention.

Referring to FIG. 5, there is shown a finishing plug 10 comprising the present invention. Finishing plug 10 shaped generally to that of a wedge comprises of a flat region 12 and a formed region matching the surfaces of a conventional raised panel door as they form a square inside corner, particularly radii 6*b* and chamfer 6*c*. Finishing plug 10 is formed utilizing conventional plastic molding techniques and materials.

Figure 6:
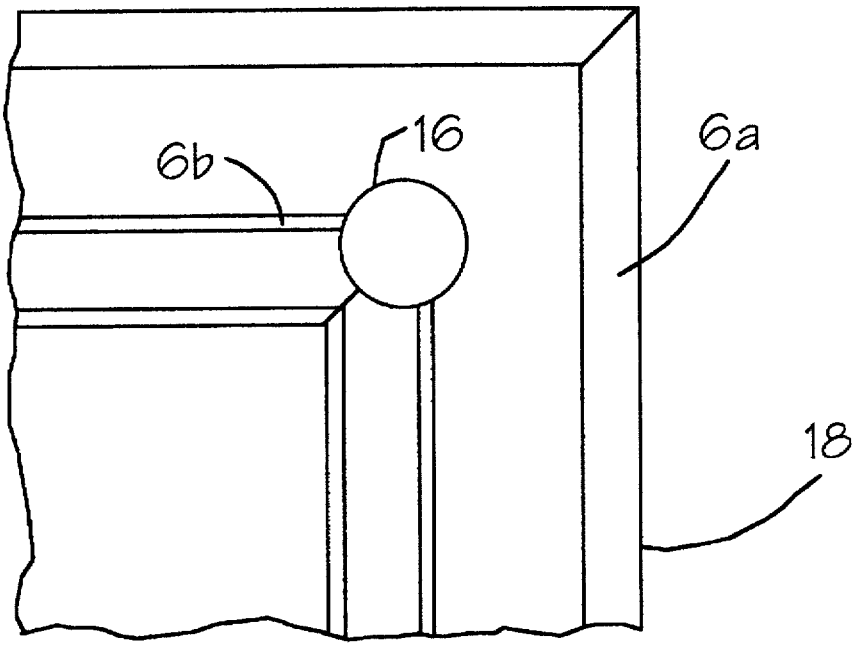
FIG. 6 is a detail view of the simulated door of FIG. 3 prior to the assembly of the embodiment of the invention in FIG. 5.

To form a square inside corner in a simulate raised panel door comprising the invention, a plug housing 16 as shown in FIG. 6, is formed into a simulated raised panel door 18 matching the general size and shape of plug 10. Plug housing 16 is a simple geometric shaped boring produced by means of conventional wood working techniques. The location a plug housing 16 is one in which the radii 6*b* and chamfer 6*c* of finishing plug 10 aligns with radii 6*b* and chamfer 6*c* machined into the simulated raised panel door 18 at a corner section. Finishing plug 10 is placed into plug housing 16 and is tapped down into plug housing 16 until the flat end surface 12 of finishing plug 10 is flush with the face of simulated raised panel door 18. Prior to the installation of finishing plug 10 an adhesive material is placed into plug housing 16 to permanently affix plug housing 16 to simulated raised panel door 18. To complete the fabrication of the simulated raised panel door 18 comprising the invention, it's surface is covered with either a wet finish or plastic film disguising the presents of finishing plug 10.

Figure 7:
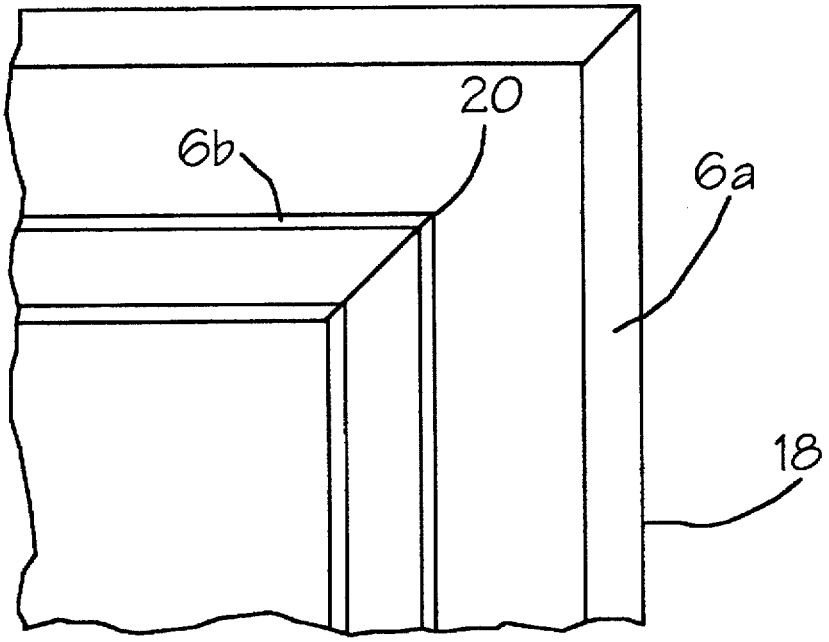
FIG. 7 is a detail view of the resulting door utilizing the embodiment of the invention shown in FIG. 5.

The resultant, as shown in FIG. 7 is a workpiece comprising a square inside corner 20, simulating the appearance of an inside corner of the conventional raised panel door. The present invention replaces the time consuming and costly operation of machining square inside corners in a wood based product. Finishing plug 10 being a plastic component requires no preparation for surface finish and eliminates the associated problems of preparing a machined wood product for surface finishing such as filling and sanding, costly problems when working in a confined area such as an inside corner.

The forming of finishing plug 10 may be done in a separate operation to said simulated raised panel door 18, such as a plastic injection molding operation or may be formed directly onto said simulated raised panel door 18 utilizing molded-in-place techniques. Either technique can produce finishing plugs in high volume at a low cost.

The embodiments of the invention in which an exclusive property or privilege is claimed are defined as follows:

1. A simulated raised panel door comprising of a single sheet of material, such as medium density fiberboard, with various shapes machined into a face of said material to reproduce a panel section of a conventional raised panel door and plug housings machined into the face of said material at locations of corner sections of said panel and preformed plugs of predetermined size and shape comprising an exposed surface having a flat region and a formed region that transitions into a side of said plug which resembles an inside square corner is assembled into said plug housings until said flat region of said plug is aligned with face of said material, and said various shapes machined into said material align with said formed region of said plug.

2. A door according to claim 1 wherein said plug is made of a plastic material.

3. A door according to claim 1 wherein said plug having a predetermined taper and a predetermined depth.

4. A door according to claim 1 wherein said plug made of plastic is formed directly within the said plug housing.

* * * * *